United States Patent [19]

Knauer

[11] Patent Number: 4,934,265

[45] Date of Patent: Jun. 19, 1990

[54] ROTARY OFFSET PRINTING MACHINE PLATE AND BLANKET CYLINDER ARRANGEMENT

[75] Inventor: Peter Knauer, Rain am Lech, Fed. Rep. of Germany

[73] Assignee: MAN Roland Druckmaschinen AG, Offenbach am Main, Fed. Rep. of Germany

[21] Appl. No.: 147,168

[22] Filed: Jan. 22, 1988

[30] Foreign Application Priority Data

Jan. 24, 1987 [DE] Fed. Rep. of Germany ..... 3702071

[51] Int. Cl.[5] ..... B41F 7/04; B41F 7/12

[52] U.S. Cl. ..... 101/177; 101/180; 101/181; 101/221

[58] Field of Search ..... 101/177, 179, 180, 181, 101/182, 183, 184, 220, 221

[56] References Cited

U.S. PATENT DOCUMENTS

| | | | |
|---|---|---|---|
| 4,398,464 | 8/1983 | Morbitzer et al. | 101/180 X |
| 4,488,483 | 12/1984 | Kohara | 101/178 |
| 4,494,457 | 1/1985 | Schwartz et al. | 101/217 |
| 4,633,777 | 1/1987 | Germann | 101/177 |
| 4,696,229 | 9/1987 | Bezler et al. | 101/177 |
| 4,753,168 | 6/1988 | Theilacker et al. | 101/177 |
| 4,788,912 | 12/1988 | Fischer | 101/177 |
| 4,798,137 | 1/1989 | Hermach et al. | 101/177 X |
| 4,827,842 | 5/1989 | Theilacker et al. | 101/177 |

FOREIGN PATENT DOCUMENTS

| | | | |
|---|---|---|---|
| 1827845 | 3/1961 | Fed. Rep. of Germany . | |
| 2214784 | 12/1972 | Fed. Rep. of Germany | 101/180 |

*Primary Examiner*—Edgar S. Burr
*Assistant Examiner*—Moshe I. Cohen
*Attorney, Agent, or Firm*—Frishauf, Holtz, Goodman & Woodward

[57] ABSTRACT

To permit selective operation of two printing couples (1, 2, 4, 5) for printing, on a continuous web (7) respectively double-image prime printing (FIG. 1), single-image prime printing (FIGS. 3, 5), while permitting flying plate changes of one of the plates of a disengaged printing couple, or prime and verso printing (FIG. 7), two impression cylinders are provided, engageable with the blanket cylinders of the respective printing couples, the impression cylinders being spaced from each other by a gap sufficient to permit passage of the web therebtween when the system operates in the prime-and-verso printing mode, with a gap sufficient so that freshly printed subject matter will not be smeared by contact with the respective impression cylinders. All the gearing is arranged on one side of the machine and a single main drive gear (8) is in selective driving engagement with gears located on shafts coupled to the respective cylinders, selective engagement and disengagement and direction of rotation being effected by engagement of clutches (9, 10, 11) located at the ends of the shafts. The arrangement of the gears and clutches permits easy assembly and maintenance.

10 Claims, 2 Drawing Sheets

ROTARY OFFSET PRINTING MACHINE PLATE AND BLANKET CYLINDER ARRANGEMENT

Reference to related patent, assigned to the assignee of the present application, the disclosure of which is hereby incorporated by reference: U.S. Pat. No. 4,696,229, Sept. 29, 1987, BEZLER et al.

Reference to related application, assigned to the assignee of the present application, the disclosure of which is hereby incorporated by reference: U.S. Ser. No. 137,245, filed Dec. 23, 1987, now U.S. Pat. No. 4,827,842 THEILACKER et al corresponding to German Appln. Pat. No. 36 44 445.6 of Dec. 24, 1986.

The present invention relates to a printing machine system, and more particularly to a printing machine system permitting flying plate change of plate cylinders in a rotary offset printing machine, and especially to such a printing machine system in which at least two printing couples can be engaged selectively, alternately or simultaneously, against a substrate web which is guided over an impression cylinder. Selectively, and as desired, the system is capable of providing both prime and verso printing on a web guided between the respective cylinders.

BACKGROUND

U.S. Pat. No. 4,696,229, BEZLER et al, assigned to the assignee of the present application and the disclosure of which is hereby incorporated by reference, discloses a structure which, generally, permits printing selectively by respective printing couples. For printing with blanket cylinders engaged against each other, with the substrate web therebetween, the impression cylinder which is not needed at that time is used as a paper guide roller. The paper guide roller is located downstream, in the path of the moving web, with respect to one of the printing couples. It may occur that, upon the first printed web contacting the impression cylinder, ink which has just been applied may smear on the substrate.

THE INVENTION

It is an object to improve a printing machine system, as generally described for example in the aforementioned U.S. Pat. No. 4,696,229, so that smearing of ink is effectively prevented.

Briefly, two impression or printing cylinders are provided, and respective printing couples are so arranged that a first blanket cylinder of a first couple is positioned in printing relation to a first one of the impression cylinders, so that a first prime printing can be applied. A second blanket cylinder of a second printing couple is positioned in printing relation to the second one of the impression cylinders to apply, if desired, a second prime printing impression. The first and second blanket cylinders are so located in the machine system that they can be placed in mutual printing relation, so that, if the substrate web is passed therebetween, prime and verso printing impressions can be formed simultaneously. The two impression cylinders are spaced from each other by such a distance that their circumferences leave a clearance gap sufficient for passage of the substrate therethrough when the first and second printing cylinders are positioned for prime and verso printing.

The gap or clearance between the impression cylinders should be large enough to permit not only straight passage of the substrate web but, also, oscillation or flutter thereof, which is normal in printing operations.

The system has the advantage that each blanket cylinder has its own impression or printing cylinder associated therewith when two-printing subject matter is to be applied in double-prime printing. By spacing the position of the impression cylinders, the path for contactless passage of the printed web is free, so that the printed web can be conducted to a subsequent printing station or to a dryer or the like. Yet, the system permits single-prime printing and flying change of plates, double-prime printing, for example two-color printing, or high-quality prime and verso printing. The system, thus, is highly versatile.

DRAWINGS

Figure 1:
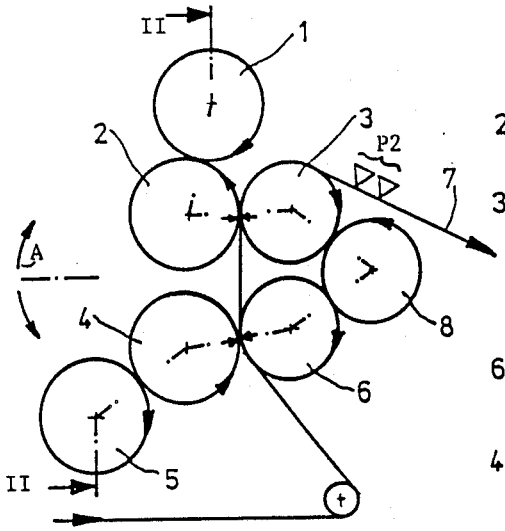
FIG. 1 is a schematic side view of the configuration of the cylinders when applying double-prime printing (2/0)

The representation of FIGS. 2, 4, 6 and 8 are generated by a section along the broken section line II—II of FIG. 1 with subsequent flipping of the projection plane in the plane of the drawing as indicated by the double arrow A in FIG. 1.

DETAILED DESCRIPTION

The printing system has a plurality of printing couples. A first printing couple is formed by a plate cylinder 1 and a blanket cylinder 2. Suitable inkers and dampers, as customarily used and which may be of any standard construction well known in the industry, have been omitted from the drawing for clarity. The blanket cylinder 2 has its shafts so retained in side walls of the machine (not shown) that it can be engaged against a first impression cylinder 3 or lifted away, that is, disengaged therefrom.

Figure 3:
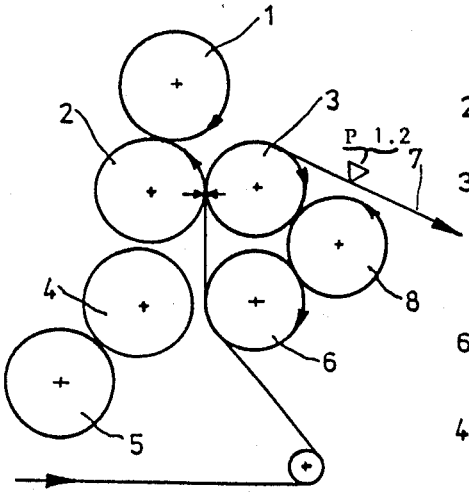
FIG. 3 is a schematic side view of the cylinder configuration for single prime printing while permitting flying plate change in a lower printing couple.
Figure 5:
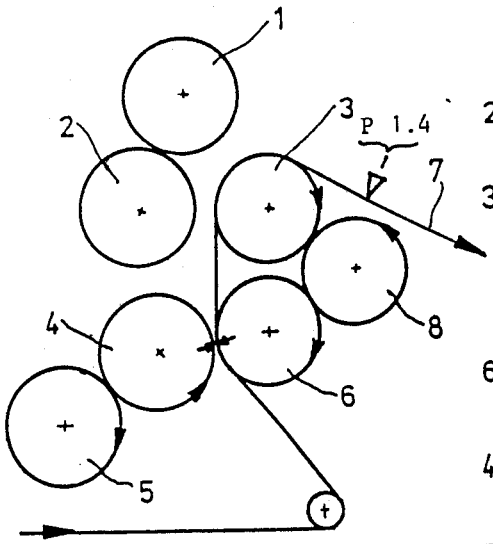
FIG. 5 is a schematic side view similar to FIG. 3 for flying plate change of the upper printing couple.
Figure 7:
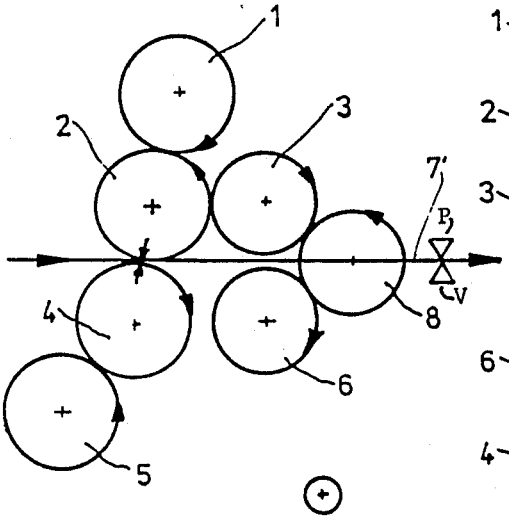
FIG. 7 is a view similar to FIG. 1 and illustrating the configuration of the cylinders for prime and verso printing (1/1)

A second printing couple is formed by a plate cylinder 5 and a blanket cylinder 4, again having the usual inkers and dampers associated therewith, and not shown. The blanket cylinder 4 is so secured in the side walls of the machine that it can be selectively engaged in three positions:

(1) Engaged with a second impression cylinder 6, as seen in FIGS. 1 and 5, for applying a first prime printing impression for double-prime printing (FIG. 1) or for applying the only prime printing impression (FIG. 5) with the first printing couple 1, 2 removed from operation to permit plate changing while the machine is operated, customarily referred to as "flying plate changing";

(2) in engagement with blanket cylinder 2 of the first printing couple, as shown in FIG. 7, to apply a verso printing impression on the web, being guided differently from the web path in FIGS. 1 and 5; and (3) an intermediate position, shown in FIG. 3, in which the printing couple 4, 5 is out of operation, to permit flying plate change on the printing plate 5.

The impression cylinders 3 and 6 are secured in the machine frame in axially fixed position and, in accordance with a feature of the invention, are so located in the machine frame that their circumferences are spaced from each other by a distance sufficient to permit clear passage of a running printing web 7 therebetween, as seen in FIG. 7, considering possible oscillations, undulations, or flutter of the printing web as it passes through the machine.

The web 7, as seen in FIG. 1, is guided by a suitable guide roller as well known about the two impression cylinders 3 and 6. The printing line is indicated by small arrows. This permits double-impression, for example two-color prime printing, as shown schematically by the two open triangles P2, and usually referred to as 2/0 printing. The blanket cylinder 4 applies the first printing impression, for example a first color, in cooperation with the printing cylinder 6. The blanket cylinder 2 applies the second printing impression, for example a second color, in cooperation with the printing or impression cylinder 3. Alternate engagement of either the one or the other blanket cylinder 2, 4 to the associated impression cylinder 3 or 6 permits application of different printing subject matter in prime printing, shown by the open arrow P1.2 in FIG. 3 and P1.4 in FIG. 5. To apply prime and verso printing, see triangles P and V in FIG. 7, the second blanket cylinder 4 is disconnected from the associated impression cylinder 6 and, rather, engaged with the first blanket cylinder 2. The path of the web 7' is guided between the two blanket cylinders 2 and 4 for application of prime and verso printing, respectively. Immediately after printing, the web 7' is guided in the gap or space or clearance between the two impression cylinders 3 and 6 without contact with either impression cylinder to a subsequent printing station or, if no further inks are to be applied, for example no further colored inks are to be printed, the web 7' can be guided to a subsequent unit, for example a dryer.

The broken circle 8 represents a drive gear, which will be explained in detail below.

In accordance with a feature of the invention, only a single main drive gearing is needed, and the gears can all be located at one side of the machine, at a "drive" side thereof. The power flow of the gears is shown in FIGS. 2, 4, 6 and 8, and derived from a main drive gear 8 which, for example, is coupled to the main drive of the printing machine in any suitable manner well known in the art. The drive gears are located in three parallel planes, extending perpendicularly to the axes of rotation of the respective gears. For better visibility and illustration, the gears have been given the same reference numerals as the cylinders in the respective FIGS. 1, 3, 5 and 7, and the position of the gears in the three parallel planes is indicated by assigning respectively prime, double prime and triple prime notation to the numerical cylinder indication.

The gears themselves are formed with spiral or inclined gearing and the pitch circle of the respective gears corresponds to the diameter of the cylinder with which they are associated, and on the shafts of which they are located. In order to permit a power transfer between specific pairs of gears, some of the gears are formed with a positive and others with a negative profile correction or profile offset. Such profile offset, which is also referred to as a profile addendum, is indicated, whether positively or negatively, by a "+" or a "−" notation on the drawings.

The gear 8, driven from the main drive of the printing machine, is in engagement with gear 3' on the shaft of the first impression cylinder 3 and with a gear 6' on the shaft of the second impression cylinder 6. These gears are in continuous engagement. The shaft of the first impression cylinder 3 further carries a gear 3''', which is freely rotatable with respect to the shaft but can be coupled to the shaft by a clutch 9. The gear 3''' has negative profile correction, and is in engagement with a gear 2''' located on the shaft of the first blanket cylinder 2, and having positive profile correction. The gear 2''' is in engagement with a gear 1''' which, likewise, has negative profile correction. The gear 2''', as shown by the broken line 24, is additionally coupled with gear 4''', which has negative profile correction, and is located on the shaft of the second blanket cylinder 4, freely rotatable on the shaft of the blanket cylinder 4, and engageable with the shaft by a clutch 11.

The shaft of the second impression cylinder 6 carries, besides the gear 6', a further gear 6'' which is freely rotatable on the shaft of the impression cylinder 6, but can be engaged with the shaft by a clutch 10. The gear 6'' has a negative profile correction or offset and is in engagement with a gear 4'', having positive profile addendum and secured to the shaft of the second blanket cylinder 4 for rotation therewith. The gear 4'' is coupled to a gear 5'' on the shaft of the plate cylinder 5. Gear 5'' has negative profile correction.

Figure 2:
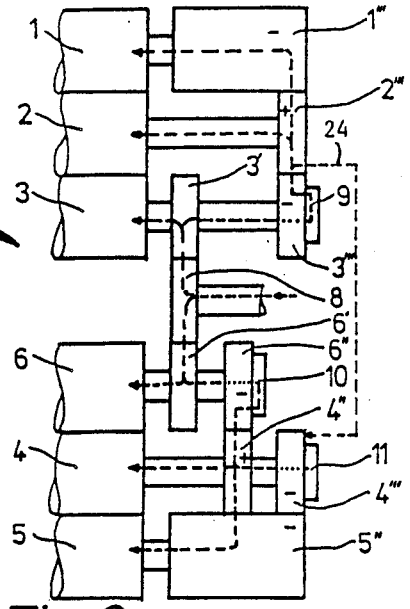
FIG. 2 is a part-longitudinal developed view through the drive side when the system is in the configuration of FIG. 1, taken along a separating or developing plane of arrows II—II of FIG. 1.

The arrangement of FIG. 2 provides for 2/0 or two-impression prime printing of the blanket cylinder 2 against the impression cylinder 3 and of the blanket cylinder 4 against the impression cylinder 6, with the web 7 being passed between the blanket cylinders and the impression cylinders. Power flow is indicated by the broken lines within the respective gears and cylinders. Starting from the main drive gear 8, power will be directed in two channels. The upper channel drives the gear 3' of the impression cylinder 3 and, through the engaged clutch 9, the pair of gears 3''', 2''' of the first blanket cylinder 2 and, further, over the pair 2''', 1''', the associated plate cylinder 1. The lower channel drives the impression cylinder 6 via the gear 6' and, over the gears 6'', 4'' with the clutch 10 engaged, the blanket cylinder 4. The gear 4'' and gear 5'' drive the associated plate cylinder 5. Feedback from the shaft of the first blanket cylinder 2 to the shaft of the second blanket cylinder 4 by the engaged gears 2''' and 4''' is prevented by the open or disengaged clutch 11, which permits free rotation of the gear 4''' on the shaft of the blanket cylinder 4.

Figure 4:
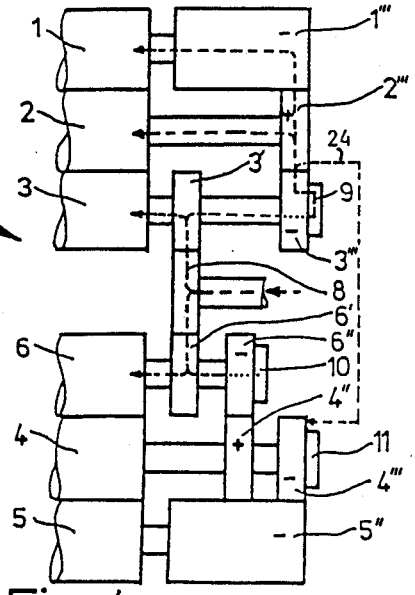
FIG. 4 is a developed view similar to FIG. 2, illustrating the power flow in the arrangement of FIG. 3.

Let it be assumed that a plate on the second plate cylinder 5 is to be changed while the machine is in operation. The second blanket cylinder 4 is then placed in its intermediate or "neutral" position and the second printing couple 4, 5 is out of operation. The power flow is shown in FIG. 4. The drive to the first printing couple 1, 2 is identical to the drive described in connection with FIG. 2. The drive to the printing couple 4, 5, however, is disconnected. Only the impression cylinder 6 is driven, and clutch 10 is opened. The clutch 10 inhibits further transmission of rotary power to the gear 6'' and then to gears 4'', 5'', and hence to the blanket and plate cylinders 4, 5. The clutch 11, likewise, remains open, so that no feedback of the drive from the blanket cylinder 2 can drive the second blanket cylinder 4. Thus, the lower printing couple 4, 5 is stopped and can be prepared for a subsequent printing impression, that is, the plate can be changed and the blanket cylinder cleaned.

Figure 6:
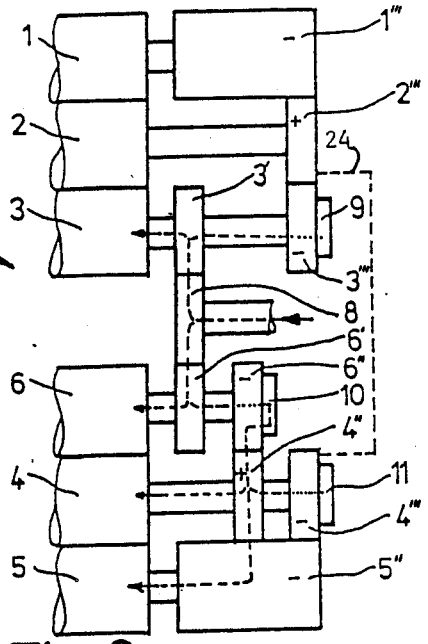
FIG. 6 is a view similar to FIG. 2 and illustrating power flow in the cylinder arrangement of FIG. 5.

Let it next be assumed that the upper printing couple 1, 2 is to be disconnected. Power flow will be as shown in FIG. 6. The blanket cylinder 2 is placed out of engagement with the impression cylinder 3. The second blanket cylinder 4 is placed in engagement with the impression cylinder 6. Power transfer will be in the upper channel through the opened clutch 9 only to the impression cylinder, but will not further transmit rotary power to the gears 2''' and 1''', since clutch 9 is disengaged. The lower channel provides power transfer from the main gear 8 through gear 6' of the impression cylinder 6. Clutch 10 is engaged and the gears 6'', 4'' of the blanket cylinder 4 and the associated plate cylinder 5 will be driven. Clutch 11 is open or disengaged. Gear 4'' drives gear 5'' of the plate cylinder 5. The disengaged clutch 11 prevents feedback of rotary energy from the shaft of blanket cylinder 4 via the connection 24 to the gear 2'''. Thus, the upper printing couple 1, 2 is stopped, and plate 1 can be prepared for a further or changed printing impression.

Figure 8:
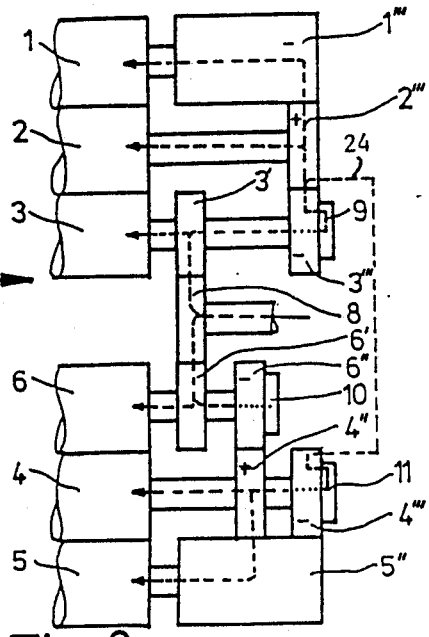
FIG. 8 is a view similar to FIG. 2 and illustrating the power flow and the cylinder arrangement of FIG. 7.

The versatility of the system is best illustrated by FIGS. 7 and 8, in which blanket cylinders 2 and 4 act, respectively, as impression cylinders for printed images transferred from plates 5 and 1. The blanket cylinder 2, in the drive engagement illustrated, remains in engagement with the impression cylinder 3. In this production arrangement, the direction of rotation of the printing couple 4, 5 is reversed with respect to that in the embodiments of FIGS. 1–6. The drive of the cylinders 4, 5 is now obtained by opening or disengaging clutch 10 and obtaining drive from the impression cylinder gear 3''', the blanket cylinder gear 2''', and gear 4''' on the shaft of blanket cylinder 4 via the now closed or engaged clutch 11. Upon engaging clutch 11, gear 4''' is driven in a direction opposite to that of gear 2''', and this direction of rotation is applied to the shaft of blanket cylinder 4 so that the gear 4'', secured thereto, can drive the gear 5''. The impression cylinder 6 also rotates and idles. Since, in accordance with a feature of the invention, the impression cylinders 3 and 6 are spaced from each other, leaving a gap sufficient for unimpeded passage of the web 7' therethrough, idle rotation of the cylinder 6 does not matter.

Gears 1''' and 5'' are axially extended, as shown in FIGS. 2, 4, 6 and 8. This axial extension is desirable to permit further power transfer to inkers and dampers, not shown in the drawings.

Use of profile correction, in positive or negative direction, respectively, is a consequence of the axial width of the gears 1''' and 5''.

Gears 1''' and 5'' of the plate cylinders 1 and 5 are also in engagement with drive gears of acceleration motors which, for example, are described in detail in the referenced U.S. Pat. No. 4,696,229. These acceleration drive motors accelerate the respective cylinders to machine speed after they have been stopped and prior to engagement of the clutches 9, 10, respectively, after disengagement of the respective printing couples, change of printing plates, and just prior to reengagement, to prevent shock to the gears.

The gearing arrangement can be constructed in a narrow space, and, therefore, can be located on one side only of the machine, forming a drive side. The clutches are located only at the ends of the shafts, which substantially improves the ease of initial assembly, and subsequent maintenance.

I claim:

1. Rotary offset printing machine system having impression cylinder means (3,6), a first printing couple (1, 2) and a second printing couple (4, 5), each printing couple having a plate cylinder (1, 5) and a blanket cylinder (2, 4) permitting, selectively, applying printed information from one of said printing couples on a substrate (7) which is in contact with said impression cylinder means during operation of the machine and while the other printing couple is stopped, or, when both printing couples are in operation, permitting selectively applying two impressions on one side of the substrate to effect double prime printing (2/0), or, upon passing said substrate between said blanket cylinders (2, 4) effecting printing on both sides of the substrate, to effect prime and verso printing (1/1), wherein the impression cylinder means comprises a first impression cylinder (3) and a second impression cylinder (6) and said system comprises further an arrangement of said respective printing couples wherein the first blanket cylinder (2) of the first couple (1, 2) is positionable in printing relation to the first impression cylinder (3) to apply, selectively, a first prime printing impression;

the second blanket cylinder (4) of the second printing couple (4, 5) is positionable in printing relation to the second impression cylinder (6) to selectively apply a second prime printing impression;

said first and second blanket cylinders being positionable in mutual printing relation to apply prime and verso printing impressions;

and wherein said first (3) and second (4) impression cylinders are spaced from each other such that their circumferences leave a clearance gap sufficient for contact-free passage of the substrate (7') therebetween when the first and second blanket cylinder (2, 4) are positioned against each other for simultaneous prime and verso printing.

2. The system of claim 1, further comprising a common drive gear (8) drivingly coupled to both the first and second impression cylinders (3, 6) as well as the blanket cylinders (2, 4) and the plate cylinders (1, 5) of the first and second printing couples.

3. The system of claim 2, further including impression cylinder drive gears (3', 6') secured for rotation with the respective impression cylinders (3, 6) and in driving engagement with said common drive gear.

4. The system of claim 2, further including impression cylinder drive gears (3', 6') secured for rotation with the respective impression cylinders (3, 6) and in driving engagement with said common drive gear;

additional impression cylinder gears (3''', 6'') secured to rotate with said impression cylinder gear (3', 6');

blanket cylinder gears (2''', 4'') secured to the first and second blanket cylinders, respectively, and in meshing engagement with said additional impression cylinder gears;

and plate cylinder gears (1''', 5'') secured to the respective plate cylinders and in meshing engagement with the blanket cylinder gears (2''', 4'').

5. The system of claim 4, wherein the plate cylinder gears (1‴, 5″) are axially extended to permit engagement thereof with accessory equipment.

6. The system of claim 2, further including first and second blanket cylinder gears (4″, 4‴), the first blanket cylinder gear (4″) being coupled for rotation with one (4) of said blanket cylinders;

a clutch (11) selectively engaging the second blanket cylinder gear for rotation with said one (4) blanket cylinder;

an impression cylinder gear (6″) meshing with said first blanket cylinder gear (4″) and a clutch (10) coupled to said impression cylinder gear, said clutch selectively engaging said impression cylinder gear (6″) for rotation with that one of the impression cylinders (6) associated with said one blanket cylinder (4);

and wherein the second blanket cylinder gear (4‴) is coupled for rotation with a further blanket cylinder gear (2‴) coupled to rotate with the other blanket cylinder (2) to permit, selectively, rotation of said one blanket cylinder (4) in either direction in dependence on respective engagement of the impression cylinder clutch (10) or the blanket cylinder clutch (11).

7. The system of claim 1, wherein a plurality of gears (1‴, 2‴, 3′, 3‴, 4″, 4‴, 5″, 6′, 6″) are coupled to drive shafts of the respective cylinders, and clutches (9, 10, 11) are provided for selective engagement of selected gears wit the drive shafts of said cylinders;

and wherein all said gears and all said clutches are located on one side of the printing machine.

8. The system of claim 1, wherein a plurality of gears (1‴, 2‴, 3′, 3‴, 4″, 4‴, 5″, 6′, 6″) are coupled to drive shafts of the respective cylinders, and clutches (9, 10, 11) are provided for selective engagement of selected gears with the drive shafts of said cylinders;

said respective cylinders including cylinder shafts projecting axially from the cylinders;

and wherein all clutches are located at the outer shaft ends.

9. The system of claim 1, including gear means (1‴, 2‴, 3′, 3‴, 4″, 4‴, 5″, 6′, 6″) coupled to respective drive shafts of said cylinders for driving the cylinders;

and wherein the pitch circles of the gears correspond to the outer diameters of the cylinders on the shaft of which they are positioned.

10. The system of claim 1, further including drive gear means (2‴, 4″) for driving the blanket cylinders;

and gear means (1‴, 3‴, 6″) in engagement with said drive gear means for driving the plate cylinders and for engagement with respective impression cylinders, in which engaged drive gear means and gear means are formed with respectively opposite gear profile correction or profile offset.

* * * * *